United States Patent [19]

Muguira

[11] Patent Number: 4,909,761

[45] Date of Patent: Mar. 20, 1990

[54] IN-LINE BREAKAWAY FUSE HOLDER

[75] Inventor: Benito Muguira, Lubbock, Tex.

[73] Assignee: Gould, Inc., Rolling Meadows, Ill.

[21] Appl. No.: 349,620

[22] Filed: May 10, 1989

[51] Int. Cl.[4] ..... H01R 13/68

[52] U.S. Cl. ..... 439/622; 337/214; 337/201; 403/21; 411/5; 411/6; 439/474

[58] Field of Search ..... 439/621,622,474,475; 403/21, 342, 343; 411/2, 3, 5, 6; 285/1, 304; 337/201, 213–215, 240

[56] References Cited

U.S. PATENT DOCUMENTS

| | | | |
|---|---|---|---|
| 3,356,806 | 12/1967 | Urani | 200/129 |
| 3,417,359 | 12/1968 | Urani | 337/201 |
| 3,518,600 | 6/1970 | Urani | 337/201 |
| 3,753,192 | 8/1973 | Urani | 337/201 |

FOREIGN PATENT DOCUMENTS

| | | | |
|---|---|---|---|
| 1309080 | 10/1962 | France | 337/201 |

*Primary Examiner*—Eugene F. Desmond
*Attorney, Agent, or Firm*—Fish & Richardson

[57] ABSTRACT

A holder for an electric fuse has a first receiving body which has an internally threaded nut assembled thereto in a manner allowing relative rotation between them. The assembly of the nut to the body allows separation of the nut from the body when a predetermined axial separating force is imparted between the parts, without damage to them. A second fuse receiving body has an external thread which engages the thread of the first body. As the threaded connection is made the body sections are drawn together to enclose the fuse therein.

4 Claims, 3 Drawing Sheets

IN-LINE BREAKAWAY FUSE HOLDER

BACKGROUND OF THE INVENTION

1. Field of the Invention

This invention relates to holders for cartridge type electric fuses. More particularly it relates to an in-line fuse holder having a breakaway capability.

2. Description of the Prior Art

It is common practice to provide electric fuses in the power lines which supply electricity to street lights or other area lighting systems. In systems where the light is located at the top of a light pole it is, again, common practice to position the fuseholders for such fuses at the base of the pole. Such an arrangement allows the fuse to protect the wires passing through the pole, the light itself, as well as, any components associated with starting or controlling the light which may be mounted on the pole. All too often such light poles are severly damaged or broken off when errant motor vehicles strike them. Under such circumstances, particularly when a pole is broken off and moved, the tensile forces on the fuseholder, and the wires and connections within the pole could easily result in breaking of the fuseholder and/or separation of connections which, in turn, could result in dangerous exposed "live" wires or connections in the vicinity of the base of the pole.

It is an object of the present invention to provide an inline fuseholder, to be positioned, e.g. in the power line to a street light, with the capability of "breaking away" into two fully insulated undamaged components upon imparting a predetermined axial force thereto.

Other objects and advantages of the present invention will become apparent from an examination of the drawing and the accompanying description.

SUMMARY OF THE INVENTION

According to the present invention a holder for an electric fuse is provided which includes a first body portion which has a recess for receiving one end of an electric fuse. A nut having an internally threaded section includes a surface which interacts with a mating surface on the first body portion. The interaction between the nut and the first body portion allows relative rotational movement between the parts, but no axial movement therebetween when they are assembled to one another. The interacting surfaces are configured to allow separation of the nut from the first body portion when a predetermined axial separating force is imparted between the parts, without damaging either part. A second body portion includes a recess for receiving the other end of the fuse. An external thread is provided on the second body portion which is adapted to threadably engage the threads on the nut. As the threaded connection is made, the second body portion, and the assembly of, the first body portion and the nut, are drawn together to enclose and confine the electric fuse in the fuse receiving recesses of the two body portions.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts and wherein:

DESCRIPTION OF THE PREFERRED EMBODIMENTS

Figures 1, 2, 3, 4:
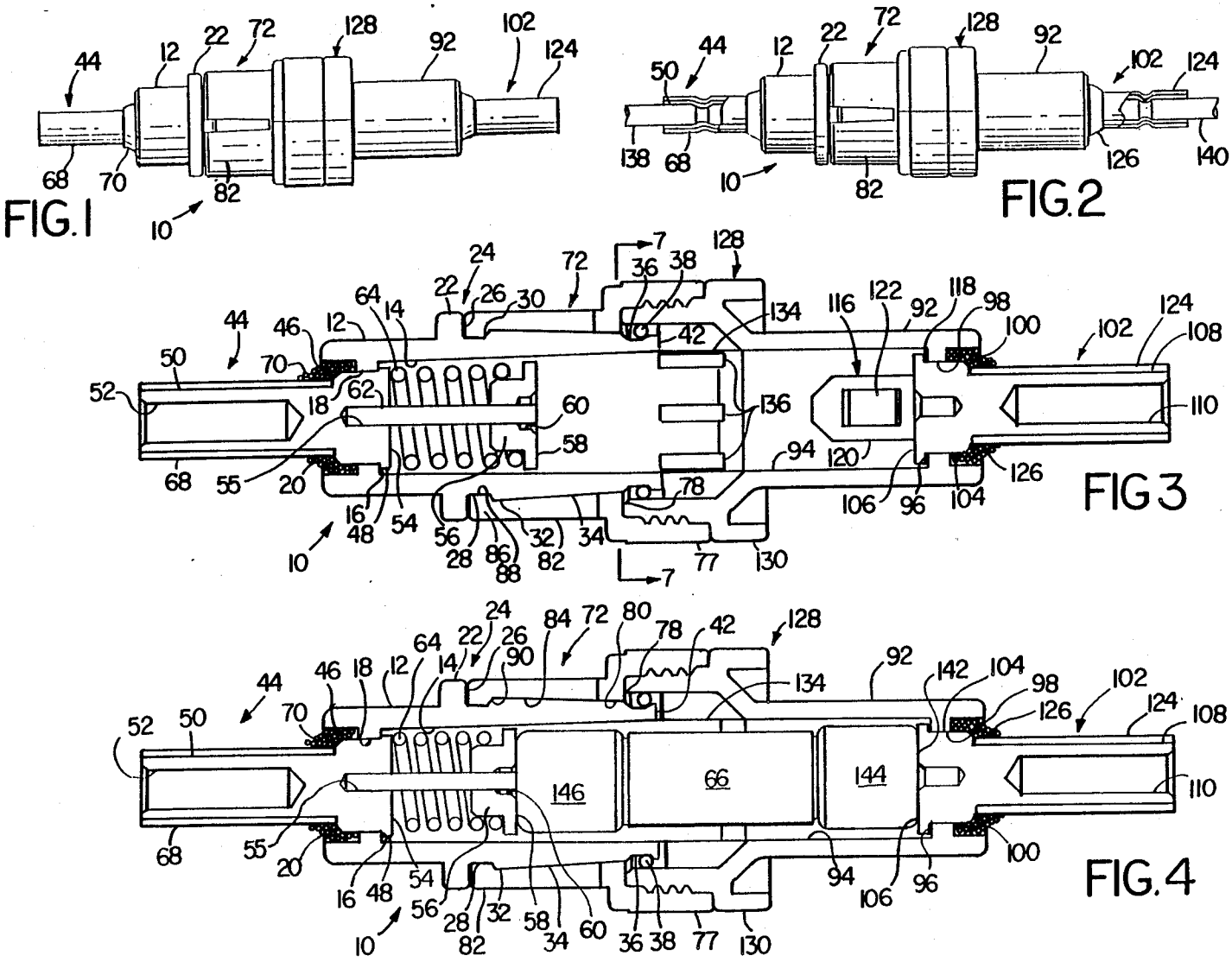
FIG. 1 is a side elevational view of a fuseholder that is made in accordance with the principles and teachings of the present invention.
FIG. 2 is the fuseholder as shown in FIG. 1, attached to two conductors, with the end connections partially broken away.
FIG. 3 is a sectional view, on a larger scale, through the fuseholder of FIG. 1.
FIG. 4 is a sectional view similar to FIG. 3 with an electric fuse operatively received therein.

Referring to all of the drawing figures in detail, the numeral 10 generally denotes a preferred embodiment of a fuseholder that is made in accordance with the principles and teachings of the present invention. The fuseholder includes a first body 12 of cylindrical form which has a cylindrical fuse receiving recess 14 therein. A wall 16 is provided at one end of the cylindrical recess 14. The other end of the recess 14 is open. An opening 18 is provided in the wall 16, and, an annular recess 20, which is formed in the outer face of the wall 16, communicates with the opening 18.

Figure 6:
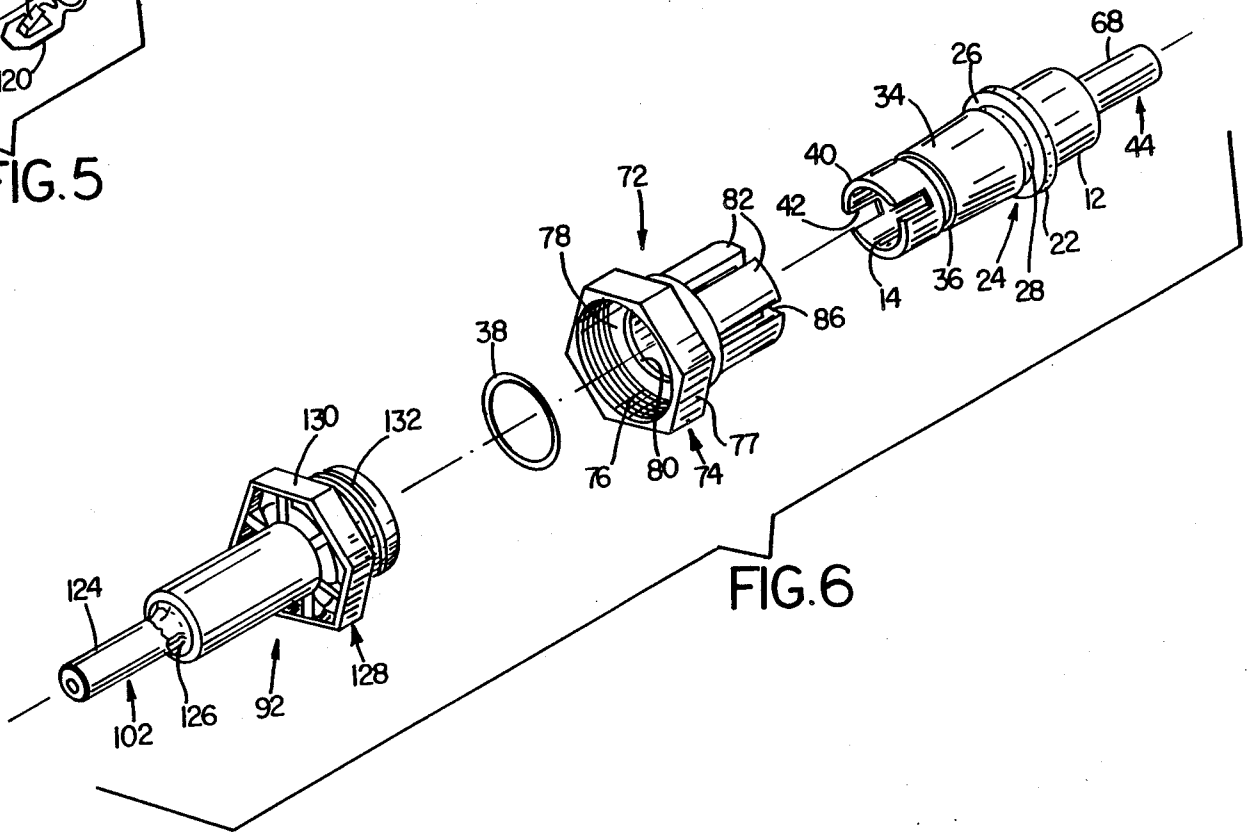
FIG. 6 is a perspective exploded view of the fuseholder of FIG. 1.

As best shown in FIGS. 3, 4 and 6 a large outwardly directed annular shoulder 22, of rectangular cross section, is formed on the exterior of the body portion 12. The shoulder 22 is somewhat closer to the left-hand end, as seen in FIGS. 3 and 4, of the body 12 than it is to the right-hand end. Directly to the right of the large annular shoulder 22 is an annular groove 24 formed in the exterior of the body 12. The groove 24 is defined by: a wall 26 of the shoulder 22 on the left; a bottom 28 having a diameter substantially the same as the portion of the body 12 to the left of the shoulder 22; and, an inclined annular surface 30. The inclined surface 30 extends from the bottom 28 upwardly and axially toward the right hand end of the body 12 to a diameter defining a small annular lip or shoulder 32 slightly larger than the diameter of the annular groove 24. In the embodiment shown the diameter of the groove 24 is 0.600 inch and the inclined surface increases to a diameter of 0.660 inch at an angle of 60 degrees from the horizontal, as viewed in the drawing figures. From the maximum diameter of the small shoulder 32 the body portion 12 defines a section of decreasing diameter 34 which may be viewed as a frusto-conical surface. The frusto-conical section 34 terminates in a shallow annular groove 36 which is adapted to receive an o-ring 38 which will be described in more detail below. The end section 40 of the body portion 12 is cylindrical and has a substantially constant diameter. As best shown in FIG. 6, a pair of longitudinally extending slots 42 extend from the end thereof to a position just short of the groove 36. The body portion 12 is perferably molded from an inexpensive but strong plastic material. A thermoplastic synthetic resin, specifically a polycarbonate has been used satisfactorily.

Figure 5:
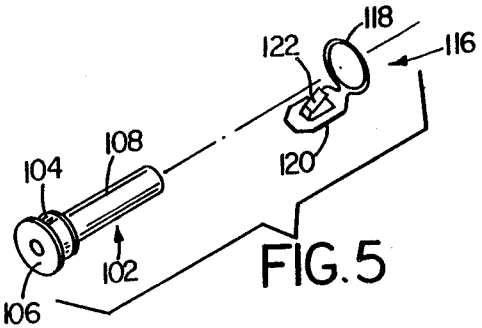
FIG. 5 is a prespective, exploded view of an end connector, fuse contact/retainer of one end of the fuseholder of FIG. 1.

As best shown in FIG. 3 and 5 the numeral 44 denotes a terminal which has an enlarged end 46 and a flanged inner face 48. The enlarged end 46 is dimensioned to fit snugly within the passage 18 in the wall 16 of the body portion 12. The flanged inner face 48 is dimensioned so it can not pass through the passage 18. The terminal 44 has an elongated shank 50 with an elongated recess 52 therein. The end surface 54 of the flanged inner face 48 is provided with a shallow socket 55 therein. When assembled the flanged inner face 48 will be pressed into engagement with the wall 16. The numeral 56 denotes a movable contact which has the form of a shallow cylinder with a radially extending flange 58 at the right hand face thereof. An axial opening 60 extends through the length of the contact 56. The right-hand end of a flexible conductor 62 extends into the opening 60 and is electrically conductively attached thereto by conventional means, e.g. a solder joint. The left-hand end of the flexible conductor 62 extends into the socket 54 in the terminal 44 and is similarly electrically conductively attached thereto.

A helical compression spring 64 surrounds the flexible conductor 62. The left-hand end of the spring 64 bears against the flanged inner face 48 of the terminal 44, while the right-hand end of the spring bears against the radially extending flange 58 on the contact 56. The helical spring 64 biases the movable contact 56 to the right as best seen in FIG. 3, but it can yield to permit the contact 56 to be moved to the left, as shown in FIG. 4 when an electric fuse 66 is installed in the fuseholder 10. The flexible conductor 62 provides a low resistance current path between the contact 56 and the terminal 44, thereby shunting the spring 64 and keeping it from being heated to temperatures at which the spring could lose some of its restorative force.

A sleeve 68 of heat shrinkable insulation is shrunk into intimate engagement with the shank of the terminal 44. The sleeve 68 extends into the recess 20 to abut the short portion of the terminal 44. A sealing material 70, such as an epoxy resin, is applied in the region of the annular recess 20 in a manner to provide a water tight seal between the terminal 44 and the body portion 12.

Reference numeral 72 denotes a nut having an internally threaded section 74 and a section thereof 76 for telescopically receiving and interacting with the body portion 12. The threaded section 74 is substantially larger in diameter than the body portion 12 and includes a plurality of threads 76, formed internally thereof, and a hexagonal wrench-receiving surface 77 at the exterior thereof. As viewed in FIGS. 1–4 the nut 72 has an end wall 78 on the right hand end which has a large opening 80 therein having a diameter slightly larger than the diameter of the end 40 of body 12. Extending to the left from the wall 78 are four elongated fingers 82 which define an elongated bore 84 for receiving the body 12. The fingers are arcuately shaped, as best seen in FIG. 6, and the interior of the bore 84, which they define, is dimensioned to receive the frustro-conical section 34 of the body 12 in a mating, clearance fit relationship.

As best seen in FIGS. 3 and 4, each of the arcuate fingers 82 has, at its outermost end, an inwardly directed annular shoulder 86. Each of the shoulders is arcuate and they cooperate to define a bore 88 having a diameter which is less than the diameter of the small annular shoulder 32 and greater than the diameter of the annular groove 24. The fingers 82 are resilient enough to allow the ends, bearing the shoulders 86, to be deflected radially outwardly. As a result of the above described structure it will be evident that the nut 72 and the body 12 may be readily assembled to one another by inserting the body 12, end 40 first, into the bore 88 of the nut 12 with sufficient force to cause the interaction, between the four shoulders 86, and the frusto-conical surface 34, to deflect the fingers 82 radially outwardly until the four shoulders 86 pass into the annular groove 24. In this condition, as shown in FIGS. 1–4 the nut 72 is free to rotate with respect to the body 12. At the same time, the nut 72 is restrained from moving axially with respect to the body 12. Following assembly of the nut 72 to the body 12 the o-ring 38 is passed over the end 40 of the body and caused to be seated in the o-ring groove 36.

With reference to FIGS. 3 and 4, the right hand facing surface 90 of each of the annular shoulders 86 is at a 60 degree angle which allows it to matingly engage the inclined surface 30 of the groove 24. The importance of this relationship to the invention and the functioning thereof will be described in more detail following the description of the remaining structural features of the fuseholder.

Referring again to all of the drawing figures, the reference numeral 92 refers to a second body portion of generally cylindrical form which has a cylindrical recess 94 therein. A wall 96 is provided at one end of the cylindrical recess 94, and the other end of the recess is open. A passageway 98 is provided in the wall 96, and, an annular recess 100, which is formed in the outer face of the wall 96 communicates with the passageway 98.

The numeral 102 denotes a terminal which has an enlarged end 104 and a flanged inner face 106. The enlarged end is dimensional to fit snugly within the passage 98 in the wall 96 of the body portion 92. The flanged inner face 106 is dimensioned so it can not pass through the passage 98. The terminal 102 has an elongated shank 108 with an elongated recess 10 therein.

Looking now at FIGS. 3 and 5 a fuse retainer element 116 is provided with a ring like section 118 which is adapted to encircle the enlarged end 104 of the terminal 102 in abutting relation with the flanged inner face 106. The retainer has an axially extending projection 120 formed with the ring section 118. The projection 120 includes a fuse contact portion thereof 122, which is partially punched out, which extends inwardly and rearwardly thereof. When assembled into the body 92 the flanged inner face 106 of the terminal 102 serves to press the ring section 118 against the wall 96 of the body 92, as shown best in FIG. 3.

As with the other terminal a sleeve 124 of heat-shrinkable insulation is telescoped over the shank 108 of the terminal 102. The sleeve 124 extends into the recess 100 to abut the enlarged end 104 of the terminal 102. A sealing material 126, such as an epoxy resin, is applied in the region of the annular recess 100 in a manner to provide a water tight seal between the terminal 102 and the body portion 92.

Figure 7:
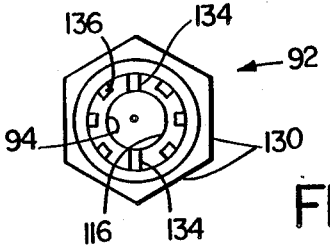
FIG. 7 is a sectional view through the fuseholder FIG. 3 taken along the line 7—7 of FIG. 3.

Integrally formed with the body portion 92 is an externally threaded nut 128 which includes a hexagonal wrench receiving surface 130 and a plurality of threads 132 which are sized to threadably mate with the internal threads 76 of the nut 72. The integrally formed nut 128 actually defines the above noted open end of the cylindrical recess 94. As best shown in FIGS. 3, 4 and 7 a number of inwardly facing axially extending projections are formed on the inner wall of the integrally formed nut 128. Two of these projections 134 are dimensioned to be received within the longitudinally extending slots 42 formed in the end 40 of the first body portion 12. The other smaller projections 136 serve to assure that the o-ring 38 is not displaced into the recess 94.

The second body portion 92 and the internally threaded nut 72 are preferably both made from the same thermosetting polycarbonate resin which is capable of having strong threads formed thereon. Both of the nuts 72 and 128, as mentioned, have wrench receiving surfaces, 77 and 130 respectively thereon which allow tightening thereof by appropriate sized wrenches.

As previously indicated, the reference numeral 66 denotes an electric fuse dimensioned to be operatively received within the cylindrical recesses 14 and 94, respectively, in the body portions 12 and 92. The fuse 66 is shown installed within the fuseholder 10 in FIG. 4. The fuse 66 has ferrule terminals at the opposite ends thereof, one 146 of which is urged into contact with the inner face of the radially extending flange 58 of the movable contact 56. The other end ferrule 144 of the fuse is urged into contact with the inner surface of the flanged inner face 106 of the other terminal 102. This ferrule 144 is also engaged on its lateral surface by the fuse contact portion 122, of the fuse retainer 116. Because of the angular relationship of the fuse contact portion 122, the electric fuse ferrule may be readily pressed into contact therewith, however, once inserted, the forces exerted on the ferrule serve to retain a fuse, and a considerable force is necessary in order to remove a fuse therefrom.

In using the fuseholder 10 of the present invention, the insulation-free end of a conductor 138 which is connected to the "line" side of an electrical circuit is inserted into the recess 52 formed within the shank 50 of the end terminal 44. Once inserted a crimping tool, not shown, is used to crimp the shank of the terminal tightly into the end of the conductor 138 as shown in FIG. 2. Following this, field installed insulation such as a splicing compound or electrical tape will be used to cover any insulation-free portion of the shank 50 and any insulation-free portion of the end of the conductor 138. The sleeve 68 of insulation formed over the shank 50 performs as an insulator and also provides a surface to which the field-installed insulation will readily adhere.

The insulation-free end of a second conductor 140 which is connected to the "load" side of the electrical circuit is similarly inserted within the recess 110 in the shank 108 of the second terminal 102. This connection is crimped and insulated in the same manner as described above with respect to the "line" side.

A fuse 66 will then be inserted into the cylindrical recess 94 in the second body portion 92. An appropriate amount of insertion pressure will result in the end surface 142 of the right-hand ferrule 144 abutting the flanged interface 106 of the terminal 102. The insertion pressure will cause the fuse contact portion 120 to yield to permit the fuse to be moved into engagement with the flanged inner face and the fuse contact section 122 will thereafter apply a holding force to the ferrule 144 to retain the fuse within the recess 94. The other end ferrule 146 of the fuse 66 will then project outwardly beyond the end of the body 92, however the electrician or maintenance man will not receive a shock if he touches that fuse terminal because the fuse is then engaged only with the "load" side rather than to the "line" side of the electrical circuit.

Assembly of the fuseholder is accomplished by taking the sub-assembly of the body portion 92 with fuse 66 installed as above described and inserting the other ferrule 146 into the cylindrical fuse receiving recess 14 of the first body portion 12. The electrician will grasp the wrench receiving surface 77 of the nut 72 in one hand and grasp the wrench receiving surface 130 of the externally threaded nut 128 in the other hand. The externally threaded nut 128, which of course forms a integral part of the second body portion, will be held stationary while the threaded nut 72, which is free to rotate with respect to the first body portion, will be caused to rotate in a direction consistent with engagement of the threads 76, of the nut 72, with the mating threads 132, on the externally threaded nut 128. Upon initiating such rotation, the first body portion 12 may rotate momentarily with the internally threaded nut 72, however, within less than half a revolution, the alignment projections 134, which are formed on the inner wall of the externally threaded nut 128, will engage with the longitudinally extending slots 42 formed in the end 40, of the first body portion 12. Such engagement will therafter prevent relative rotational movement between the first and second body portions 12, 92. Following this, continued rotation of the internally threaded nut 72 will cause the body sections to move axially towards one another, and will eventually cause contact of the other ferrule 146 with the radially extending flange 58 of the movable contact 56. FIG. 4 illustrates the assembled fuseholder with a fuse 66 installed therein and, it should be noted, that, when in the final assembled position the spring 64, engaging the movable contact 56, has been compressed, and the flexible conductor 62 has been taken out of tension. As a result, the spring force will assure a good electrical contact of both of the fuse ferrules 144, 146 with their respective contacts 106, 56.

It should be noted that, prior to the time the fuse ferrule 146 engages the radially extending flange 58 of the movable contact 56, the right-hand end 40 of the first body portion 12 will have telescoped within the left-hand end, i.e. the externally threaded portion of the second body portion 92. This arrangement assures that any arc which could form as the ferrule 146 of the fuse engages the radially extending flange of the contact 56 would be wholly enclosed and could not injure the person assembling the fuseholder.

As thus assembled the fuseholder comprises a water tight enclosure for the electric fuse 66, with the joint between the body portions sealed by the o-ring 38 which is carried in the o-ring groove 36 of the first body portion and which is compressed into contact with the inner surface of the externally threaded nut 128 when the fuseholder is assembled. Both end terminals of the fuse assembly are sealed by a waterproof epoxy adhesive, as described above, and as shown at reference numerals 70, and 126.

Figure 8:
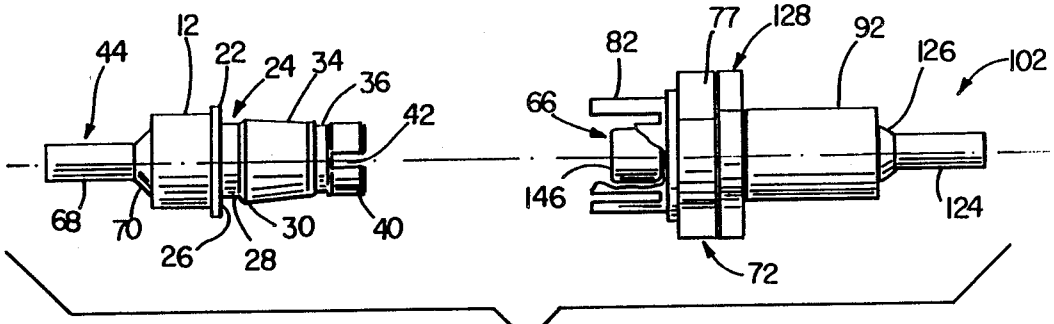
FIG. 8 is a side elevational view, partially broken away, of the fuseholder of FIG. 1 following separation according to the present invention.

As mentined above a typical use for the fuseholder 10 is in the base of a support pole for a street lamp where the fuseholder would normally be mounted in a vertically extending position. When a support pole making use of a fuseholder 10 according to the present invention is broken off and moved, and a tensile force is imparted to the electrical line carrying the fuseholder 10, the fuseholder will pull apart into two fully insulated, undamaged components, when, the axial force imparted to the fuseholder exceeds a predetermined level. FIG. 8 illustrates the fuseholder 10, 5 and the fuse 66 contained therein, following such an axial force having been imparted thereto. It should be noted that in this condition the fuse continues to be retained by the fuse retaining contact 122 within the recess 94 of the second body portion. The internally threaded nut 72 which had previously been snap fit assembled to the first body portion 12 remains threadably engaged with the externally threaded nut 128 of the second body portion 92. The first body portion, i.e. the "line" side, remains fully insulated, with no "live" surfaces with which inadvertent contact by a repairman or the like could cause serious personal injury or death. It should be noted that, when the fuseholder pulls apart into the separated condition, the o-ring 38 is moved out of its retaining groove 36 when the inwardly facing shoulders 86 of the arcuate fingers 84 of the nut 72 are dragged thereover as the nut is removed from the first body portion.

Following a successful separation of the fuseholder to the condition as shown in FIG. 8 reassembly of the fuseholder may be readily carried out when the light pole is being repaired. Such reassembly requires unthreading of the internally threaded nut 72 from the second body portion 92; reassembly of the internally threaded nut 72 to the first body portion by the same procedure described hereinabove with respect to initial assembly, resulting in the inwardly facing annular shoulders 86 snap fitting into the annular groove 24 in the first body portion. Following this, the o-ring 38 is reassembled into the o-ring groove 36 and the fuseholder is ready to be used again.

Looking now at the physical design of the fuseholder which permits the above described "breaking away" into two fully insulated undamaged components, reference is made back to the description of the interface between the inclined annular surface 30 and the right-hand facing surfaces 90 of each of the annular shoulders 86 at the ends of the arcuate fingers 84. As described above, these surfaces define mating contact surfaces at a 60 degree angle from the horizontal. The frictional engagement between these mating surfaces and the degree of flexibility of the four arcuate fingers 84 are carefully selected such that upon imparting an axial force upon the conductors 138, 140 attached to the fuseholder the four fingers will flex outwardly and disengage the annular groove 24 in the first body portion 12 resulting in the separation described hereinabove prior to any damage occurring to the conductors 138, 140 or to the other structural components of the fuseholder 10.

Accordingly it should be appreciated that an inline waterproof fuseholder has been provided which is initially simple to assemble and which has the capability of "breaking away" into two fully insulated undamaged components upon the imparting of a predetermined axial force thereto. Further, following such separation, the fuseholder may be readily reassembled and continued in use for its designated purpose.

This invention may be practiced or embodied in still other ways without departing from the spirit or essential character thereof. The preferred embodiment described herein is therefore illustrative and not restrictive, the scope of the invention being indicated by the appended claims and all variations which come within the meaning of the claims are intended to be embraced therein.

What is claimed is:

1. A holder for an electric fuse comprising:

(a) a first body portion having a recess therein for receiving one end of an electric fuse;

(b) a nut having an internally threaded section;

(c) interacting surfaces on said first body portion and on said nut to permit said nut to be assembled with said first body portion in a manner allowing relative rotational movement therebetween, said interacting surfaces substantially axially fixing said first body portion and said nut with respect to one another; said interacting surfaces further allowing separation of said nut from said first body portion when a predetermined axial separating force is imparted therebetween, without damage to either;

(d) a second body portion having a recess therein, for receiving the other end of the electric fuse, and, an external threaded portion that is adapted to threadably engage the threads on said internally threaded nut to draw said second body portion, and, said assembly of said first body portion and said nut together, in assembled relation, to enclose and confine the electric fuse in the fuse receiving recesses of said first and second body portions.

2. The apparatus of claim 1 wherein said interacting surface on said first body portion comprises a large outwardly directed annular shoulder on the exterior thereof, intermediate the ends thereof, and, an outwardly directed small annular shoulder on the exterior thereof axially spaced, in the direction of said fuse receiving recess, a short distance from said large annular shoulder; said large annular shoulder and said small annular shoulder defining an annular groove therebetween; and wherein said interacting surface on said nut comprises a body engaging section, extending axially from said threaded section, having a bore therein for telescopically receiving said first body portion therein; said bore being defined by a plurality of resiliently radially deflectable arcuate fingers, said arcuate fingers defining a primary bore diameter slightly larger than the diameter of said first body portion, and, said fingers having on the interior thereof, at their outermost ends, an inwardly directed annular shoulder means which define a bore having a diameter less than the diameter of said small annular shoulder, and, greater than the diameter of said annular groove; whereby said body engaging section of said nut may be telescopically engaged with said first body portion and an axial force upon said nut, urging said nut toward said body, will result in said arcuate fingers engaging said small annular shoulder, and, the ends thereof will deflect radially outwardly allowing said inwardly directed shoulder means to pass axially over said small annular shoulder and into said annular groove.

3. The apparatus of claim 1 wherein both said first and second body portions have a terminal that is fixedly secured to and carried by said body portion.

4. The apparatus of claim 3 wherein each of said terminals has a hollow shank extending axially outwardly beyond said body portion to accommodate one end of a conductor.

* * * * *